US010301054B2

(12) United States Patent
Pell et al.

(10) Patent No.: US 10,301,054 B2
(45) Date of Patent: May 28, 2019

(54) DRINK CONTAINER WITH INTEGRATED STORAGE COMPARTMENTS

(71) Applicants: Matthew Allen-Tesch Pell, Plainfield, IL (US); Cody Duane Grandadam, Peru, IL (US)

(72) Inventors: Matthew Allen-Tesch Pell, Plainfield, IL (US); Cody Duane Grandadam, Peru, IL (US)

(73) Assignee: AccuBow, LLC, Peru, IL (US)

( * ) Notice: Subject to any disclaimer, the term of this patent is extended or adjusted under 35 U.S.C. 154(b) by 0 days.

(21) Appl. No.: 16/116,526

(22) Filed: Aug. 29, 2018

(65) Prior Publication Data

US 2019/0061984 A1 Feb. 28, 2019

Related U.S. Application Data

(63) Continuation of application No. 29/661,588, filed on Aug. 29, 2018.

(Continued)

(51) Int. Cl.
*B65D 1/04* (2006.01)
*B65D 1/06* (2006.01)

(Continued)

(52) U.S. Cl.
CPC ..... *B65D 1/04* (2013.01); *A47G 19/2205* (2013.01); *B65D 1/06* (2013.01); *B65D 25/04* (2013.01); *B65D 43/16* (2013.01)

(58) Field of Classification Search
CPC ..... B65D 21/0233; B65D 21/0201; B65D 21/02; B65D 21/0204; B65D 21/0202; B65D 21/0237; B65D 1/04; B65D 25/04; A45C 11/20; A45F 3/16
USPC ..... 220/501, 503, 507, 23.89, 23.88, 23.87, 220/23.86, 23.83, 23.4, 4.01, 505; 215/6, 215/10; 206/546, 541, 223, 216, 217
See application file for complete search history.

(56) References Cited

U.S. PATENT DOCUMENTS 3,590,989 A * 7/1971 Wittwer ..... B65D 21/0237 206/459.5
4,950,083 A * 8/1990 Bavaveas ..... B65D 21/0237 206/219

(Continued)

FOREIGN PATENT DOCUMENTS

WO 2014111489 7/2014

OTHER PUBLICATIONS

International Search Report for related International Application No. PCT1/US18/48584, dated Nov. 15, 2018 (2 pages).

(Continued)

*Primary Examiner* — Robert J Hicks
(74) *Attorney, Agent, or Firm* — Barnes & Thornburg LLP

(57) ABSTRACT

A drink container has multiple integrated storage compartments removably secured below an openable chamber configured to receive contents for consumption by a user of the drink container. A top assembly covers the chamber and includes a removable top member, an openable cap and a clip. The drink container also includes a first retaining member and a displaceable base with a second retaining member and an internal storage compartment. In an assembled state, the first and second retaining members secure the storage compartment in an intermediate cavity below the chamber. The storage compartment is separated from the cavity by applying a radially outward disconnection force on the compartment. Once disconnected, the integrated storage compartments can be filled within contents, or the contents of the integrated storage compartments can be added to the chamber for consumption by the user or directly consumed by the user.

29 Claims, 15 Drawing Sheets

Related U.S. Application Data

(60) Provisional application No. 62/551,389, filed on Aug. 29, 2017.

(51) Int. Cl.

| | |
|---|---|
| *A47G 19/22* | (2006.01) |
| *B65D 43/16* | (2006.01) |
| *B65D 25/04* | (2006.01) |

(56) References Cited

U.S. PATENT DOCUMENTS

| | | | | |
|---|---|---|---|---|
| 6,206,218 | B1 * | 3/2001 | Young | B65D 21/0204 220/23.4 |
| 2005/0082295 | A1 * | 4/2005 | Jagger | A47G 19/2205 220/500 |
| 2014/0091086 | A1 | 4/2014 | Sorensen et al. | |
| 2015/0298865 | A1 | 10/2015 | Kolb et al. | |
| 2016/0280447 | A1 | 9/2016 | Beardsell | |

OTHER PUBLICATIONS

Written Opinion for related International Application No. PCT/US18/48584, dated Nov. 15, 2018 (5 pages).

"Golchi—Polyfunctional Bottle. NEXT IDEA new tech. Water system. Water spout" (NEXT IDEA); https://www.youtube.com/watch?v=MousnjZ4IPc>; Oct. 14, 2016.

FuelshakerPro, available at goo.gl/1KsYxJ, Oct. 15, 2015, 1 page.

ShakerBottle, available at goo.gl/df7MUR, May 7, 2014, 1 page.

* cited by examiner

DRINK CONTAINER WITH INTEGRATED STORAGE COMPARTMENTS

CROSS-REFERENCE TO RELATED APPLICATIONS

This Application claims the benefit of U.S. Provisional Patent Application No. 62/551,389, filed on Aug. 29, 2017 and U.S. Design Application No. 29/661,588, filed on Aug. 29, 2018, which applications are incorporated in their entirety herein by reference and made a part hereof.

FEDERALLY SPONSORED RESEARCH OR DEVELOPMENT

N/A

TECHNICAL FIELD

This disclosure relates to a container with integrated storage compartments. In particular, the drink container has multiple integrated storage compartments that can be radially disconnected therefrom by a user to access contents within the selected compartments.

BACKGROUND OF THE INVENTION

Transporting and consuming supplements in various locations typically requires a user to measure and place a predetermined amount of the supplements in individual plastic baggies. Once the supplements are placed in these plastic baggies, the user then takes these plastic baggies along with a container that is capable of mixing the supplements with a liquid to a remote location. During transportation, the plastic baggies may be lost or ripped. This is problematic because the supplements cannot be taken by the user at this remote location. If the plastic baggies make it to the remote location, the user combines the supplements from one or more of the baggies in the container. Once the supplements have been emptied into the container, the user typically throws away the plastic baggies. This is also problematic because it increases the number of plastic materials that end up in landfills.

Accordingly, there is an unmet need for a reusable container that is capable of storing, transporting, and mixing supplements for consumption by the user. A full discussion of the features and advantages of the present invention is deferred to the following detailed description, which proceeds with reference to the accompanying drawings.

SUMMARY OF THE INVENTION

In some implementations, the present disclosure provides a reusable container with multiple integrated storage compartments. The drink container includes a top assembly that has a removable top member and an openable cap operably connected to the top member. The drink container also includes an intermediate assembly. The intermediate assembly has a top chamber configured to receive contents for consumption by a user of the drink container, a first retaining member, a rib, and a bottom member. The arrangement of the rib, the bottom member, and the intermediate wall form an intermediate cavity that is configured to receive an integrated storage compartment. The drink container also includes a base having a second retaining member. When the drink container is in an assembled state, the first and second retaining members retain the integrated storage compartment in the intermediate cavity.

Other features and advantages of the invention will be apparent from the following specification taken in conjunction with the following drawings.

BRIEF DESCRIPTION OF THE DRAWINGS

The drawing figures depict one or more implementations in accord with the present teachings, by way of example only, not by way of limitation. In the figures, like reference numerals refer to the same or similar elements.

Figure 1:
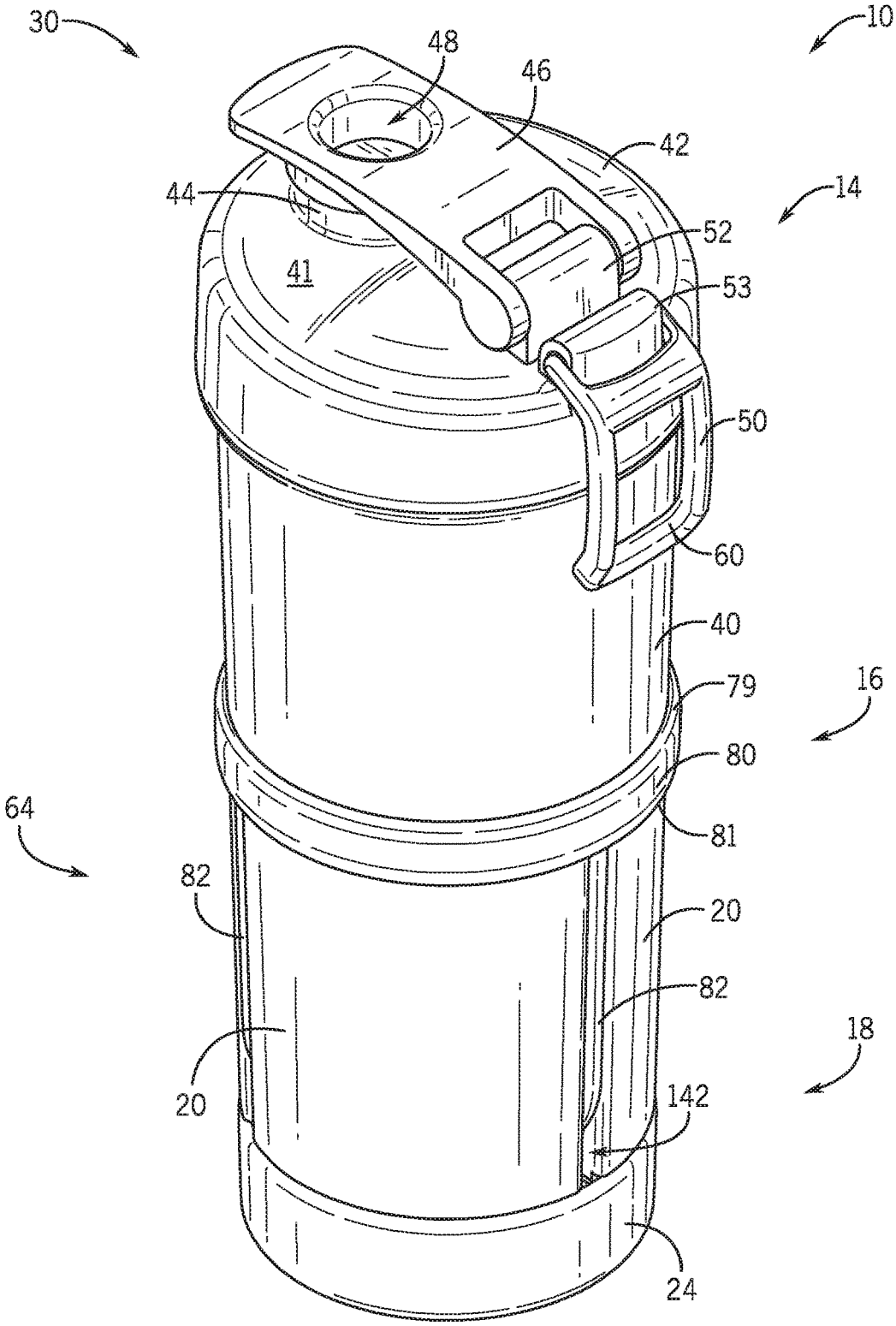
FIG. 1 is a top perspective view of a first embodiment of a drink container with multiple integrated storage compartments, showing the container in an assembled state wherein a top assembly is closed.
Figure 2:
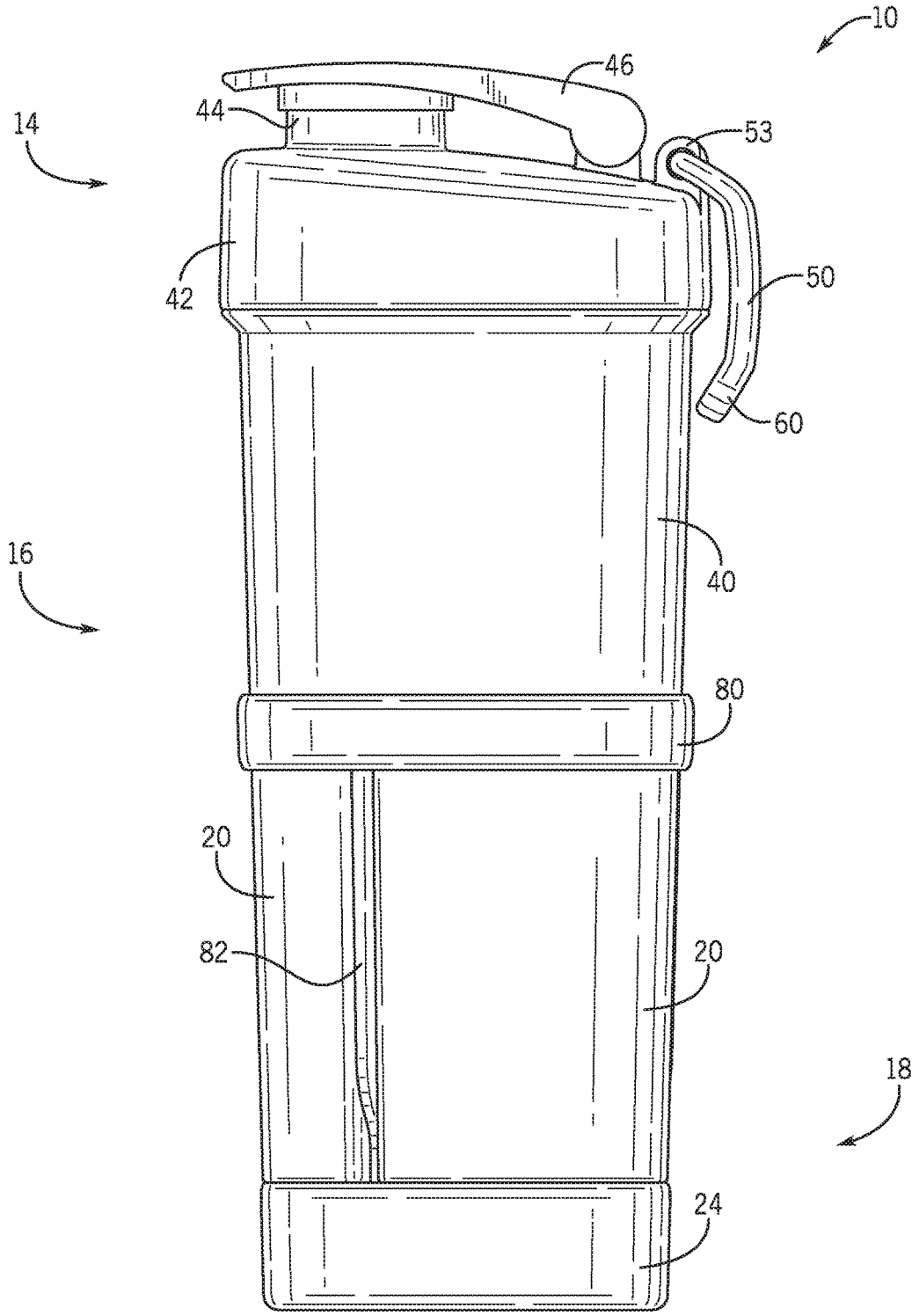
FIG. 2 is a left side view of the container of FIG. 1.
Figure 3:
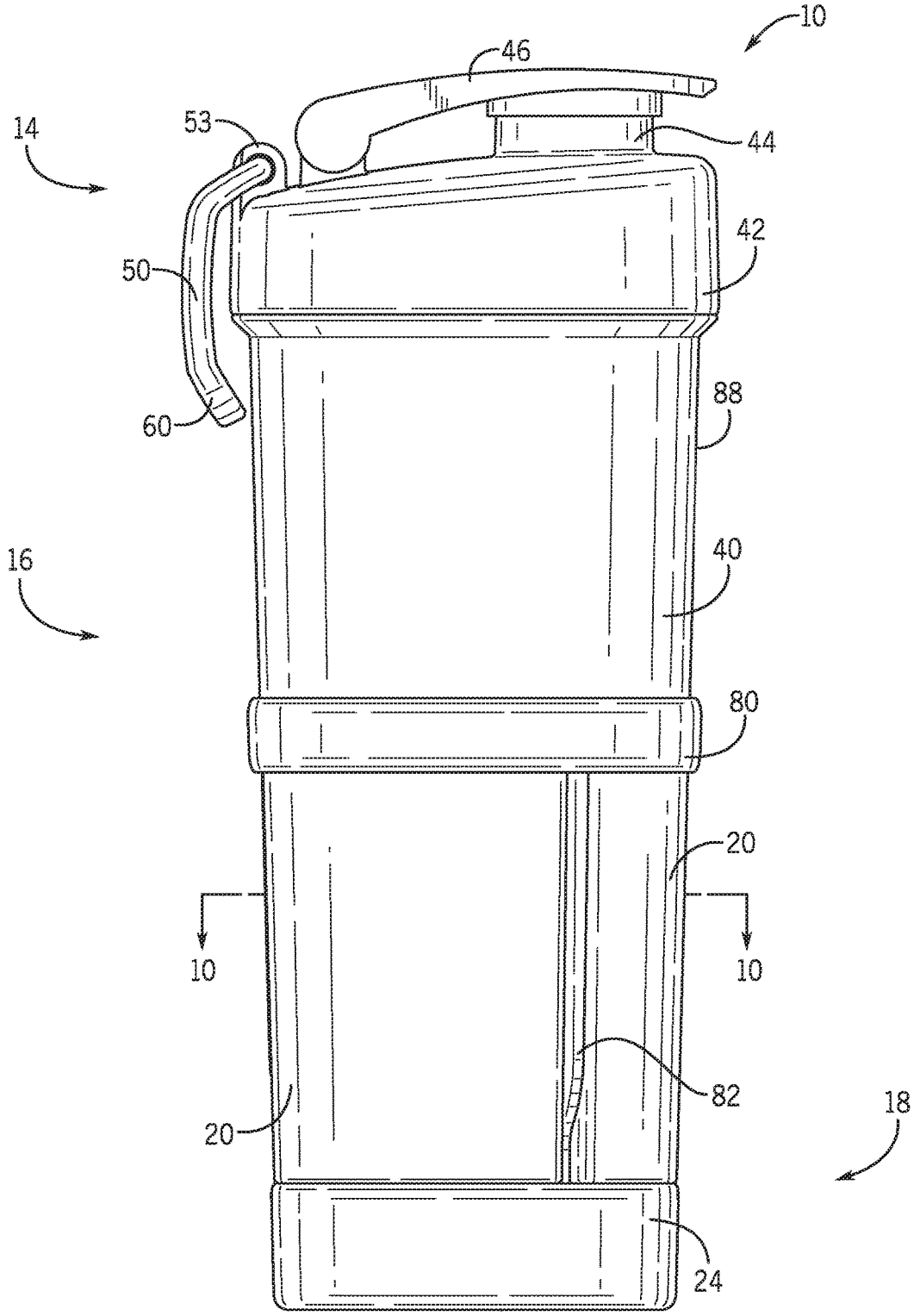
FIG. 3 is a right side view of the container of FIG. 1.
Figure 4:
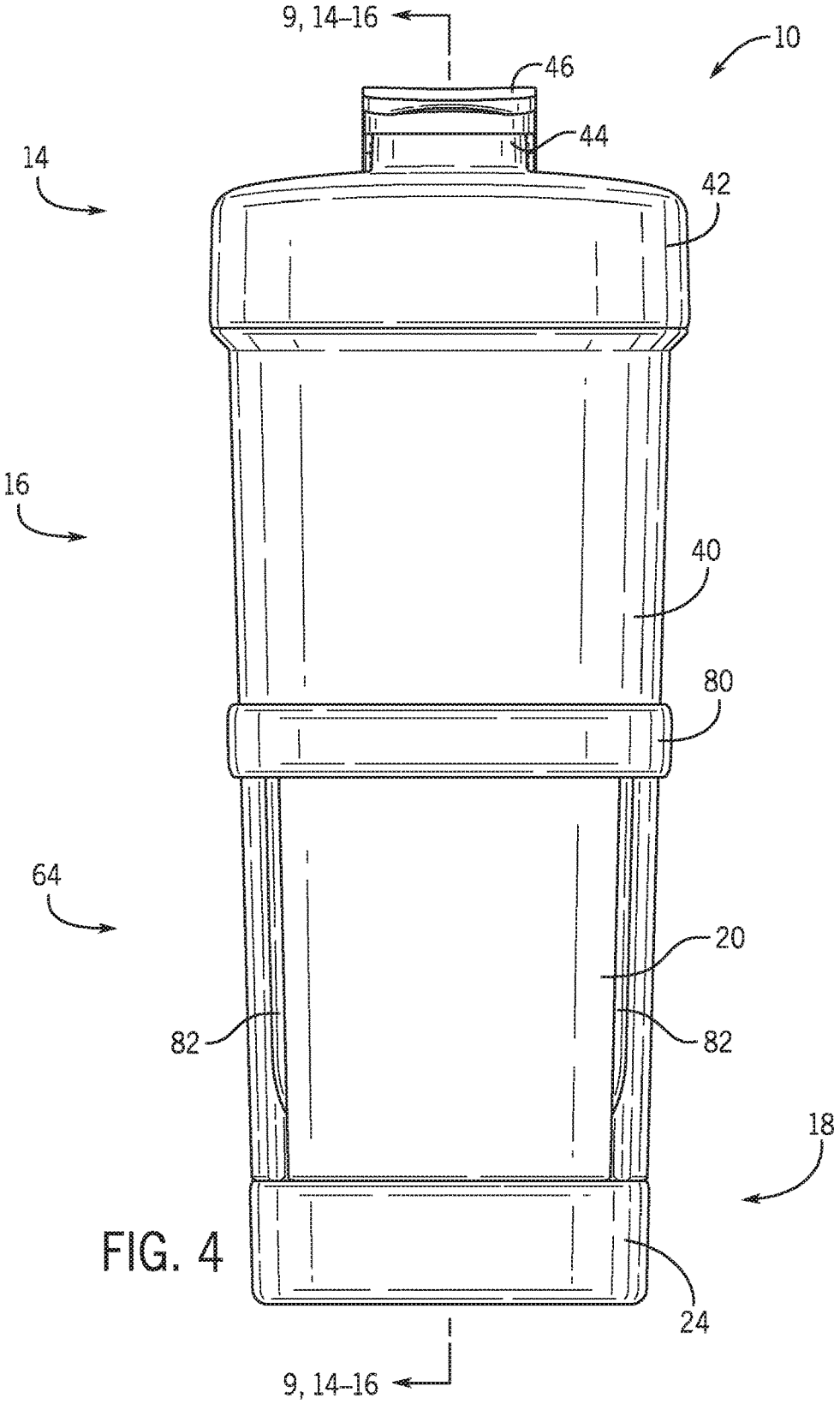
FIG. 4 is a front view of the container of FIG. 1.
Figure 5:
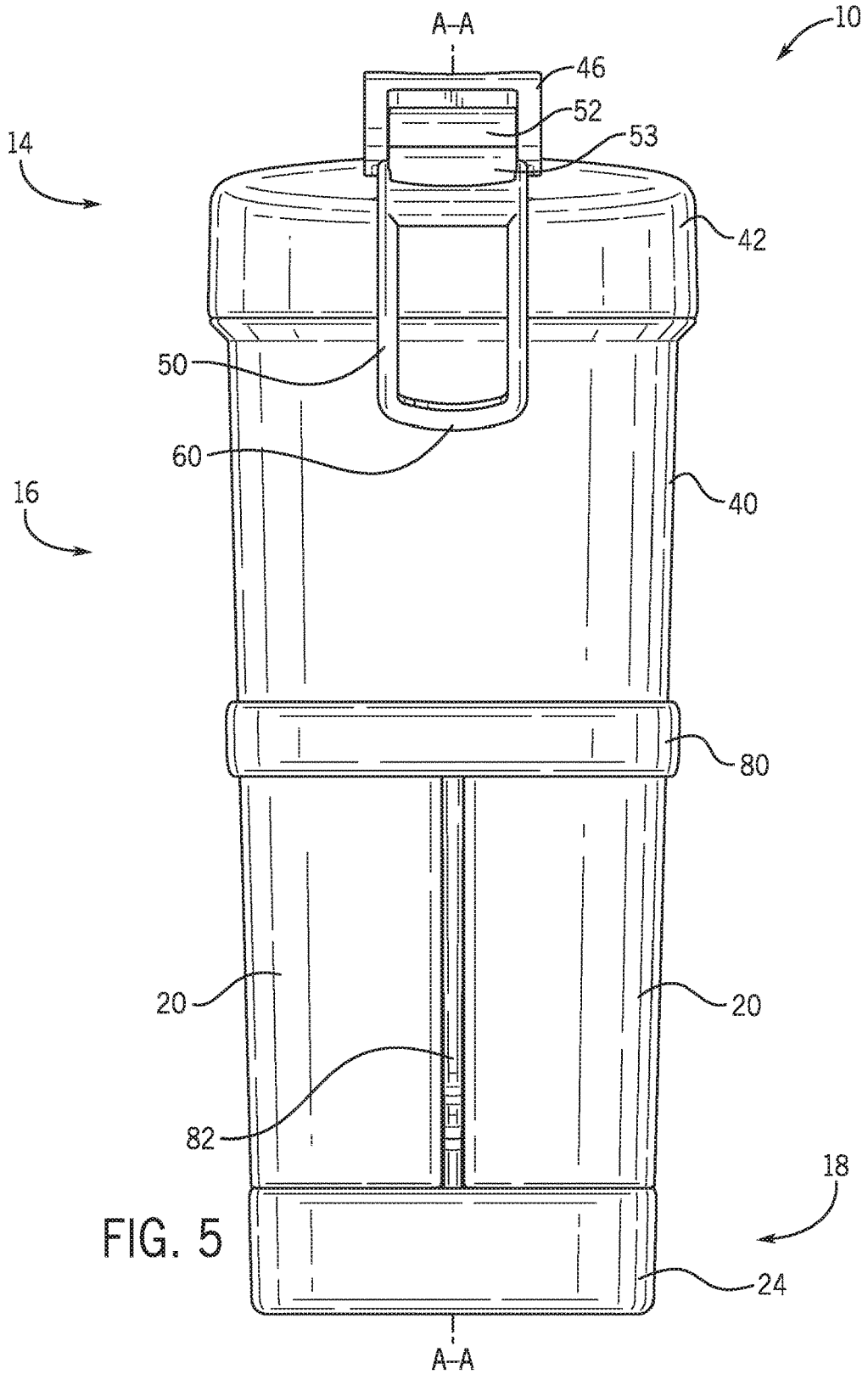
FIG. 5 is a rear view of the container of FIG. 1.
Figure 6:
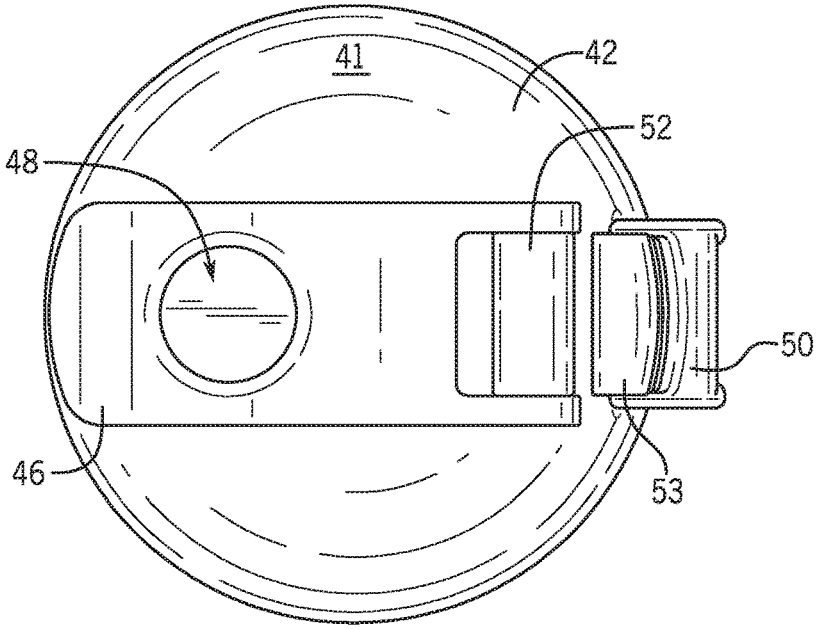
FIG. 6 is a top view of the container of FIG. 1.
Figure 7:
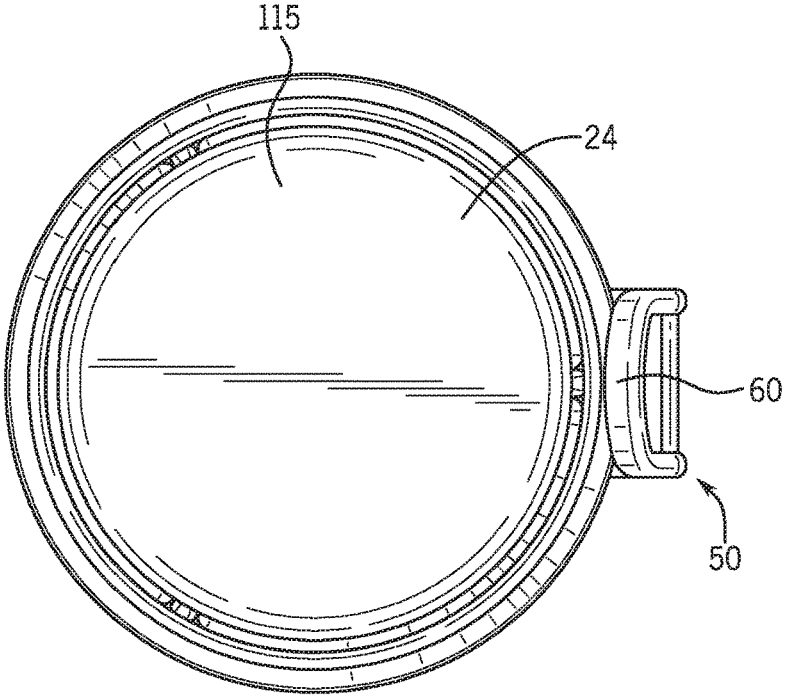
FIG. 7 is a bottom view of the container of FIG. 1.

While the invention will be described in connection with the preferred embodiments shown herein, it will be understood that it is not intended to limit the invention to those embodiments. On the contrary, it is intended to cover all alternatives, modifications, and equivalents, as may be included within the spirit and scope of the invention as defined by the appended claims.

DETAILED DESCRIPTION

While this disclosure includes a number of details and implementations in many different forms, there is shown in the drawings and will herein be described in detail particular implementations with the understanding that the present disclosure is to be considered as an exemplification of the principles of the disclosed methods and systems, and is not intended to limit the broad aspects of the disclosed concepts to the implementations illustrated.

This disclosure relates to a container 10 with multiple integrated storage compartments 20 removably secured below an openable chamber 58 configured to receive contents for consumption by a user of the drink container. With its storage compartments 20, the container 10 allows for efficient transportation and consumption of substances (e.g., protein powder, nuts, fruits, or other supplements) at various locations. For example, the container 10 may be utilized to: (i) transport supplements from a first location (e.g., a house) to a second location (e.g., a gym), (ii) mix supplements at the second location in a liquid (e.g., water), and (iii) consume the liquid and supplement combination at the second location. As explained below, each integrated storage compartment 20 is secured within the container 10 and then can be radially separated or disconnected from the container 10 at a time and location determined by the user.

As shown in the Figures, the drink container or container 10 includes a top assembly 14, an intermediate assembly or main body assembly 16, and a bottom assembly 18. The intermediate assembly 16 includes the openable chamber 58 and at least one integrated storage compartment 20, which is configured to be radially disconnected by the user from the container 10. This radial disconnection allows the user to remove the integrated storage compartment 20 from the container 10 without exposing the substance that is contained within the integrated storage compartment 20. When the container 10 is configured with multiple integrated storage compartments 20, the user can selectively disconnect one of the multiple integrated storage compartments 20 without requiring the disconnection of other integrated storage compartments 20. This selective disconnection feature increases the utility and functionality of the container 10 by allowing the user to access, fill and/or refill a specific compartment 20, as desired, with content that can be directly consumed or added to the chamber 58 for subsequent consumption.

Figure 9:
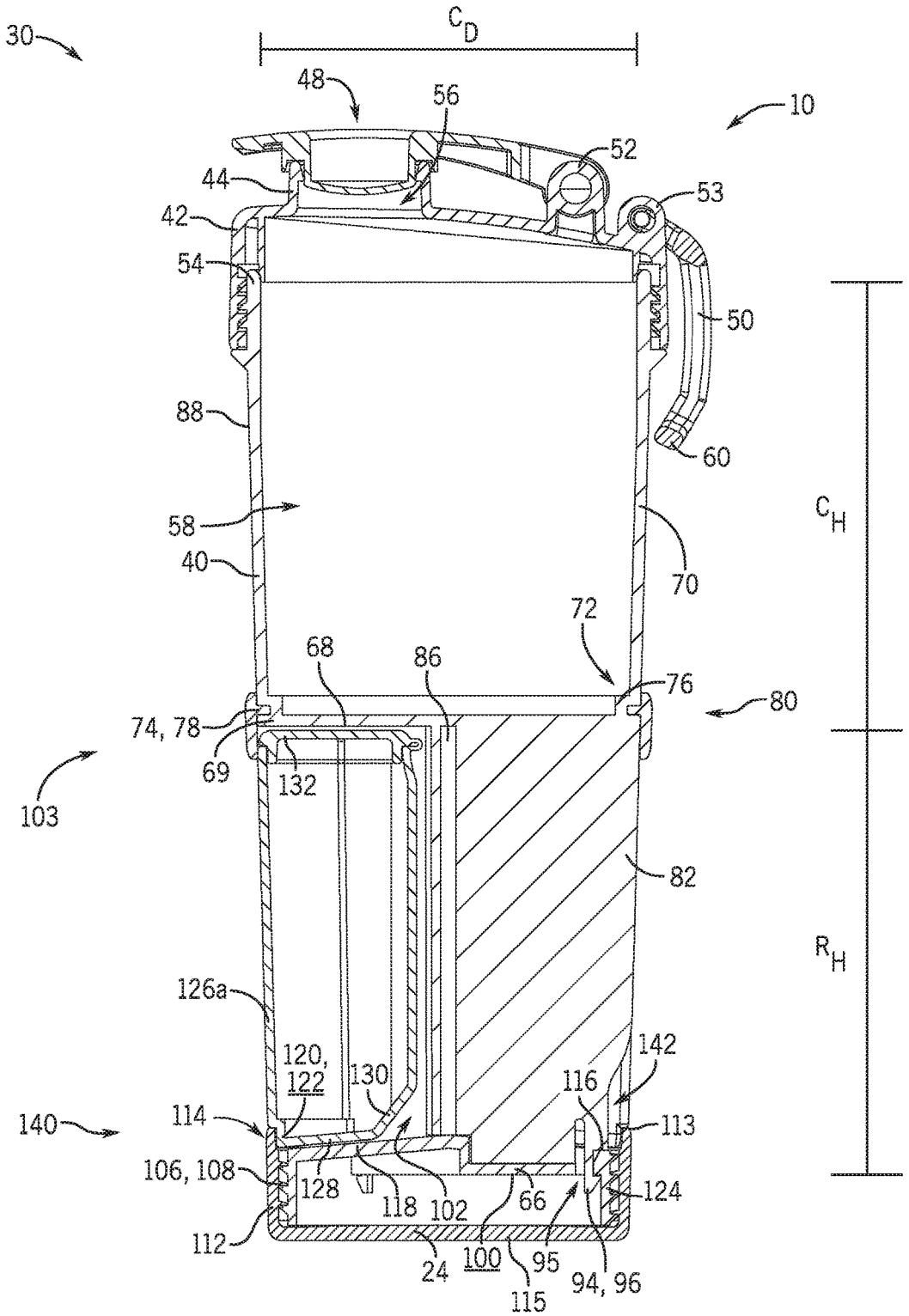
FIG. 9 is a cross-sectional view of the container shown in FIG. 1 taken along line 9-9 of FIG. 4, showing the container in the assembled state.
Figure 14:
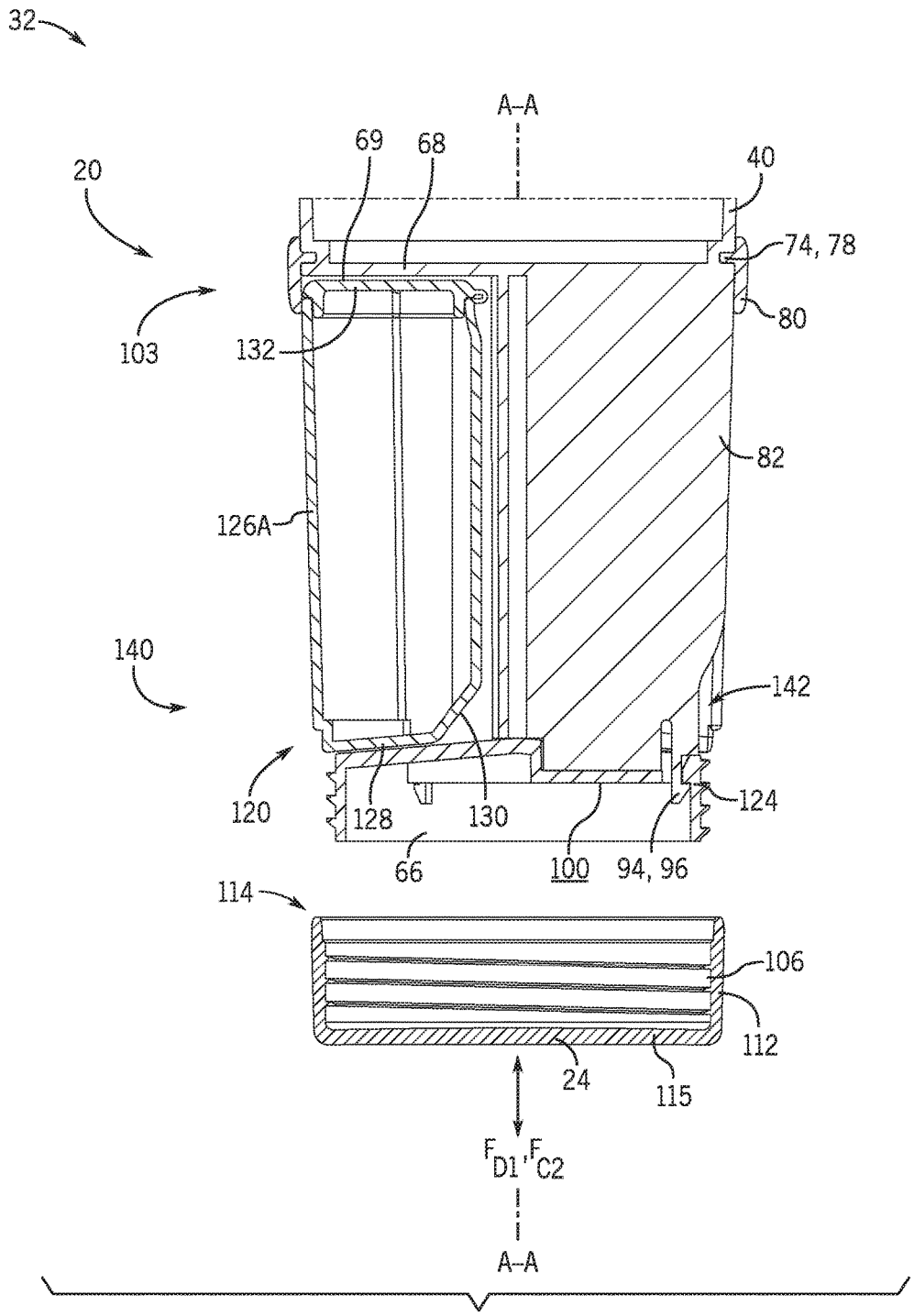
FIG. 14 is a partial cross-sectional view of the container of FIG. 1 taken along line 14-14 of FIG. 4, wherein the container is in a disconnected base state.
Figure 15:
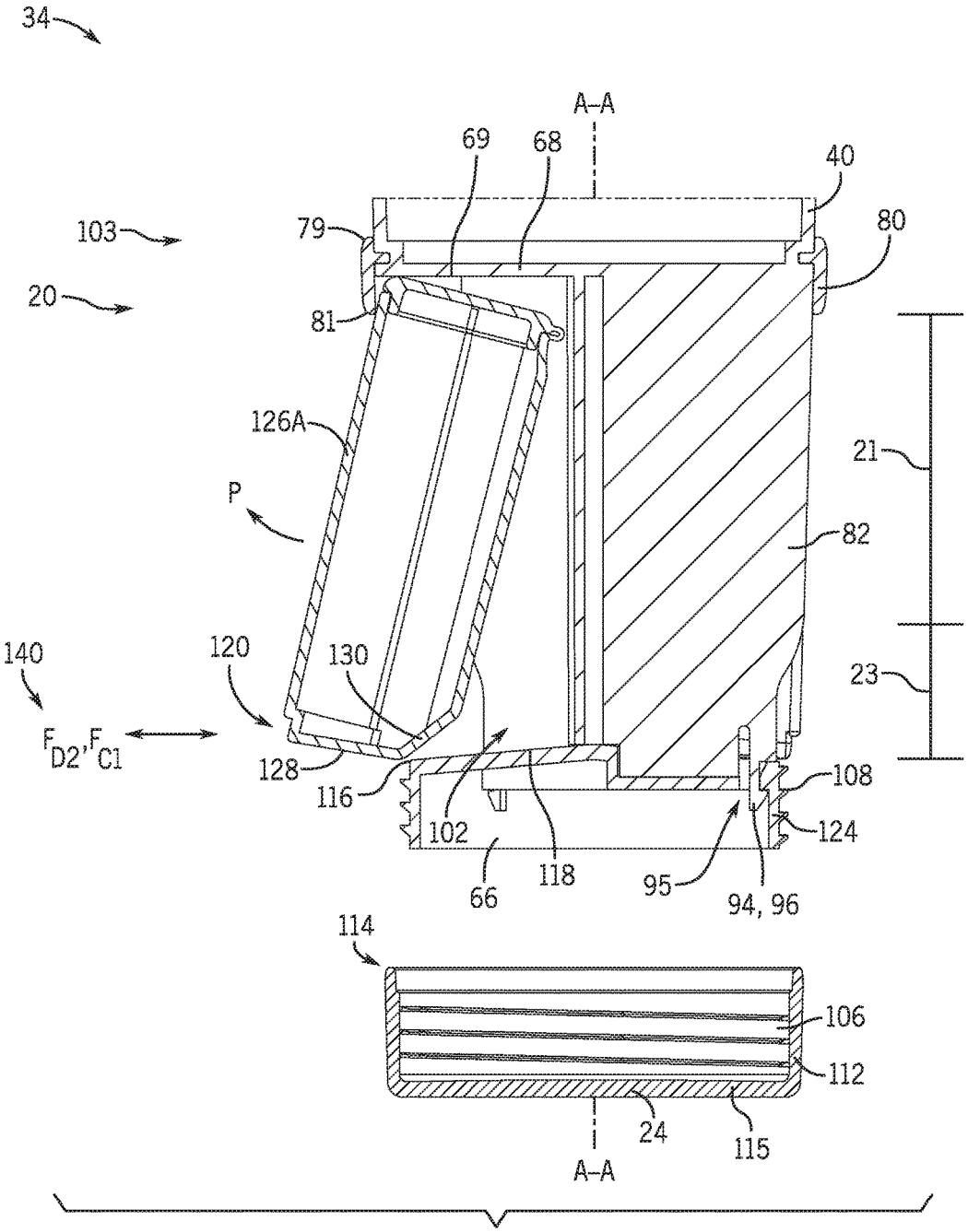
FIG. 15 is a partial cross-sectional view of the container of FIG. 1 taken along line 15-15 of FIG. 4, wherein the container is progressing to a disconnected compartment state.
Figure 16:
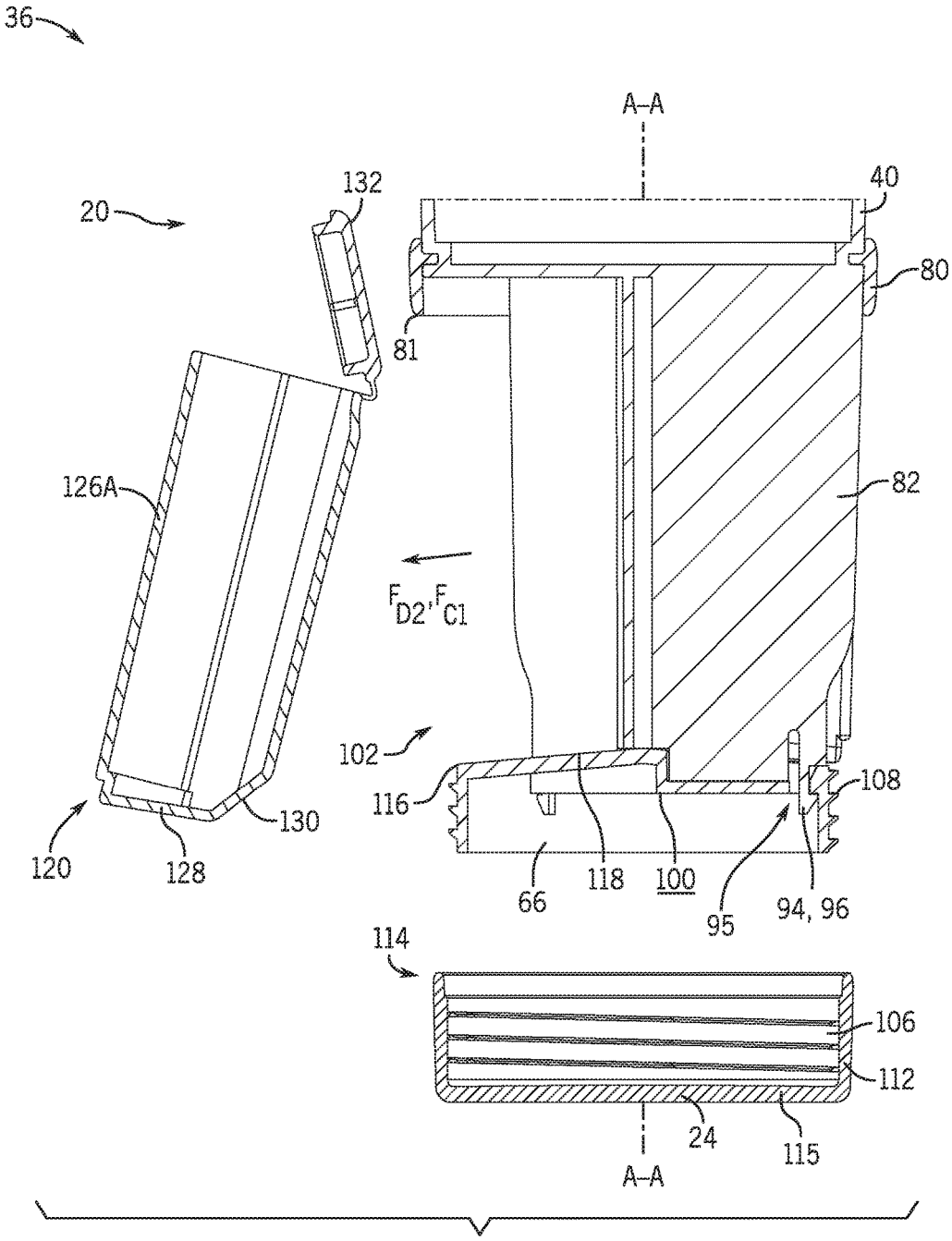
FIG. 16 is a partial cross-sectional view of the container of FIG. 1 taken along line 16-16 of FIG. 4, wherein the container is in the disconnected compartment state and a filling compartment state.

FIGS. 9, 10 and 14-16 provide cross-sectional views of the container 10 in various operating states. In particular, FIG. 9 shows the container 10 in an assembled state 30, wherein a removable base 24 and the integrated storage compartments 20 are positioned adjacent to a bottom member 66 of the container 10. In this assembled state 30, the container 10 is fully assembled and is ready to be carried from location to location by the user. FIGS. 11 and 14 show the container 10 in a first partially disassembled state or a disconnected base state 32, wherein the integrated storage compartment 20 remains positioned adjacent to a bottom member 66, but the base 24 has been removed from the bottom member 66. In particular, a first disconnection force $F_{D1}$ is applied to the base 24 to remove the base from the intermediate assembly 16, namely the bottom member 66. FIG. 15 shows the container 10 in a second partially disassembled state wherein the container 10 is progressing to a disconnected compartment state 34, wherein the base 24 has been removed from the bottom member 66 and the storage compartment 20 has been partially disconnected from a cavity 102 of the intermediate assembly 16. Once the base 24 has been removed from the bottom member 66 through application of the first disconnection force $F_{D1}$, a second disconnection force $F_{D2}$ can be applied to the integrated storage compartment 20 to disconnect it from a first retaining member 80 and the cavity 102. Finally, FIG. 16 shows the container 10 in the disconnected compartment state and a filling compartment state 36, wherein both the base 24 and the integrated storage compartment 20 have been removed from the bottom member 66. In this state 36, the integrated storage compartment 20 is completely removed from the container 10 and can be filled with a substance (e.g., protein powder, nuts, fruit, or other supplements) or the substance contained within the integrated storage compartment 20 may be emptied into the openable chamber 58 of the intermediate assembly 16. Accordingly, the container 10 provides for the efficient transportation and consumption of different substances (e.g., protein powder, nuts, fruits, or other supplements) at various locations.

Referring to FIGS. 1 and 9, the top assembly 14 is configured to be operably coupled to the intermediate assembly 16 and retain any substance that is contained within the openable upper chamber 58. The top assembly 14 includes a cup member 40, a top member 42 and a cap 46 with a projection 48. The cup member 40 and the top member 42 form the openable chamber 58 which is configured to store contents (e.g., liquid or powder contents) for consumption by the user. As such, the top member 42 has a circumference that is larger than the circumference of the cup 40 and has a top coupling structure 55. The top coupling structure 55 is configured to engage with an intermediate coupling structure 54 of the intermediate assembly 16. These coupling structures 54, 55 may be external and internal threads, which enable the user to removably connect the top member 42 to the cup 40. It should be understood that the engaging structures 54, 55 may be a pin and socket, a quarter-turn thread, a partial thread, a bayonet connector, or any other type of similar connector that is known to one of skill in the art.

The top member 42 also has a spout or mouthpiece 44 and a first hinge 52. The spout 44 extends from the upper surface 41 of the top member 42 and includes a hole 56 formed therein. The hole 56 allows a user to remove the contents of the upper chamber 58 without removing the top member 42 from the cup 40. To ensure that the contents of the chamber 58 are not inadvertently discharged, the projection 48 of the cap 46 fits within the hole 56 and creates a friction fit with an extent of the spout 44 to obstruct the hole 56. Also, to help ensure that the cap 46 is not lost by the user, the cap 46 is pivotally connected to the top member 42 by the first hinge 52. It should be understood that different configurations and/or combinations of tops and caps may be used. For example, the friction fit cap 46 may be replaced with a threaded cap, a partially threaded cap, a push-pull cap, a sports cap, or any other cap known to one of skill in the art.

The top assembly 14 also includes a clip 50 that allows a user to secure the container 10 to a support structure or article, such as a backpack or brief case. The clip 50 is pivotally connected to the top member 42 by a second hinge 53. The clip 50 can be positioned in a retracted position, where the bottom portion 60 of the clip 50 is positioned below the top member 42. The clip 50 can also be positioned in a deployed position, where the bottom portion 60 of the clip 50 is positioned above the top member 42. It should be understood that other types of connectors and/or projections may be utilized instead of this clip 50 to enable a user to couple or hang the container 10 from another structure.

Referring specifically to FIGS. 1 and 8-10, the intermediate assembly 16 includes: the cup 40, a first retaining member 80, a rib assembly 64, a bottom member 66 and at least one integrated storage compartment 20. As mentioned above, the cup 40 is configured to receive a substance for the user to consume, such as a liquid (e.g., water or energy drink) or a combination of a liquid and supplements. The cup 40 is formed from a circumferential side wall 70 that upwardly extends from the periphery of an intermediate wall or horizontal support member 68. The intersection between the walls 70 and the intermediate wall 68 may have a stepped or notched configuration 72, an inner angle that is nearly 90°, or may a curved section that extends between the walls 70 and the intermediate wall 68. The stepped configuration 72 includes a peripheral recess 74 in the walls 70 of the cup 40, which in turn forms a projection 76 into the cup 40. The recess 74 is configured to receive an extent of a projection 78 of a first retaining member 80. The first retaining member 80 is positioned proximate to the periphery of the horizontal support member 68 and encircles the cup 40. As such, the first retaining member 80 is externally located and can replaced if it is worn or damaged over time and usage of the container 10. The first retaining member 80 has an upper edge 79 that is positioned above the horizontal support member 68 and a lower edge 81 that is positioned below a lower edge 69 of the intermediate wall 68. In the assembled state 30, the first retaining member 80 overlies an upper extent 103 of the integrated storage compartment 20 when it is positioned within an intermediate cavity 102. The cavity 102 is formed from the arrangement of the horizontal support member 68, the ribs 82 and the bottom member 66. The first retaining member 80 overlies and engages this upper extent 103 by being positioned radially outward of an outer surface 127 of the integrated storage compartment 20. Due to this overlying configuration, the upper extent 103, including the uppermost edge of the compartment 20, of the integrated storage compartment 20 is obscured from view by the first retaining member 80 (see FIGS. 1-5).

Referring to FIG. 9, the cup 40 has a height $C_H$ and a diameter $C_D$, wherein the height $C_H$ is approximately the same as a diameter $C_D$. Preferably, the diameter $C_D$ is between 110% and 70% of the height $C_H$ of the cup 40 and most preferably between 95% and 85%. For example, in an exemplary commercial embodiment diameter $C_D$ is 3.5 inches and the height $C_H$ is 3.9 inches. To note, the height $C_H$ of this exemplary commercial embodiment may be substantially the same as the height $R_H$ of a ribs 82. This configuration allows most users to fit a substantial extent of their hand within the cup 40 to enable easy cleaning of the cup 40 and helps ensure that the container 10 is not too top heavy when a substance is contained within the top chamber 58. This configuration also enables the cup 40 to hold between 24 and 12 ounces of liquid, preferably between 20 and 16 ounces of liquid, and most preferably 18 ounces of liquid.

The first retaining member 80 helps ensure that the integrated storage compartment 20 remains secured within the intermediate 102 in the assembled state 30 and does not accidentally become disconnected from the intermediate cavity 102. As discussed in greater detail below, to remove the integrated storage compartment 20 from the intermediate cavity 102, the user must apply: (i) a first disconnection force $F_{D1}$ to remove the base 24 from the intermediate assembly 16 and (ii) a second disconnection force $F_{D2}$, which is substantially horizontal to the longitudinal axis A-A (see FIG. 15) of the container 10, on a lower portion 140 of the integrated storage compartment 20. This second disconnection force $F_{D2}$ causes the lower portion 140 of the integrated storage compartment 20 to pivot P around the lower edge 81 the first retaining member 80. Once the integrated storage compartment 20 has pivoted an appreciable amount (e.g., approximately 30°), the upper extent 103 of the integrated storage compartment 20 is disengaged with the first retaining member 80. In other words, the integrated storage compartment 20 is disengaged from the first retaining member 80, when the first retaining member 80 no longer obstructs the radial movement of the integrated storage compartment 20 away from the intermediate cavity 102. At this point, the integrated storage compartment 20 is fully removed from the intermediate cavity 102 and can be filled with a substance for consumption by the user.

The first retaining member 80 may be a separate and distinct piece from the intermediate assembly 16 and may be formed from a different material. For example, the first retaining member 80 may be flexible (e.g., formed from a rubber or a similar substance), while the intermediate assembly 16 may be rigid (e.g., formed from hard plastic, metal, or a similar substance). Its flexible composition allows the first retaining member 80 to elastically deform when the integrated storage compartments 20 are coupled to or removed from the intermediate cavity 102. Additionally, the flexible first retaining member 80 helps prevent the integrated storage compartment 20 from opening, when a user disconnects the integrated storage compartment 20 from the intermediate cavity 102. The flexible first retaining member 80 provides these benefits because it elastically deforms, which helps ensure that a lower edge of the first retaining member 80 does not inadvertently engage or "catch" a top edge of the integrated storage compartment 20. Further, this flexible first retaining member 80 may provide a non-slip grip interface for the user to grasp when using the container 10. It should be understood that the first retaining member 80 may be made from other materials or may be integrally formed with the intermediate assembly 16 provided it remains capable of engaging the storage compartment 20 and then deforming when the disconnection force $F_{D2}$ is properly applied.

Referring to FIGS. 8-10 and 14-16, the rib assembly 64 extends downward from the intermediate wall 68 and includes between one and six ribs 82, preferably between two and four ribs 82, and most preferably three ribs 82. In the embodiment of the Figures, the rib assembly 64 consists of three ribs 82*a*-82*c* that are oriented 120 degrees apart and that intersect with one another a point 84 that is substantially in the center of the cup 40. Each rib 82 extends radially outward from point 84 towards the outer edge 88 of the cup 40. This configuration of the ribs 82 forms three substantially identical intermediate cavities 102. Each one of these intermediate cavities 102 is configured to removably receive one integrated storage compartment 20. Because these intermediate cavities 102 have substantially similar shapes, the integrated storage compartments 20 have substantially similar shapes. This, in turn, does not require the installation of a specific integrated storage compartment 20 in a specific intermediate cavity 102. In another embodiment (not shown), the compartments 20 are configured with different sizes and volumes, and the cavities 102 are also configured with specific sizes and volumes wherein each cavity 102 accepts only one specific compartment 20 to provide a keyed arrangement between these components.

Figure 10:
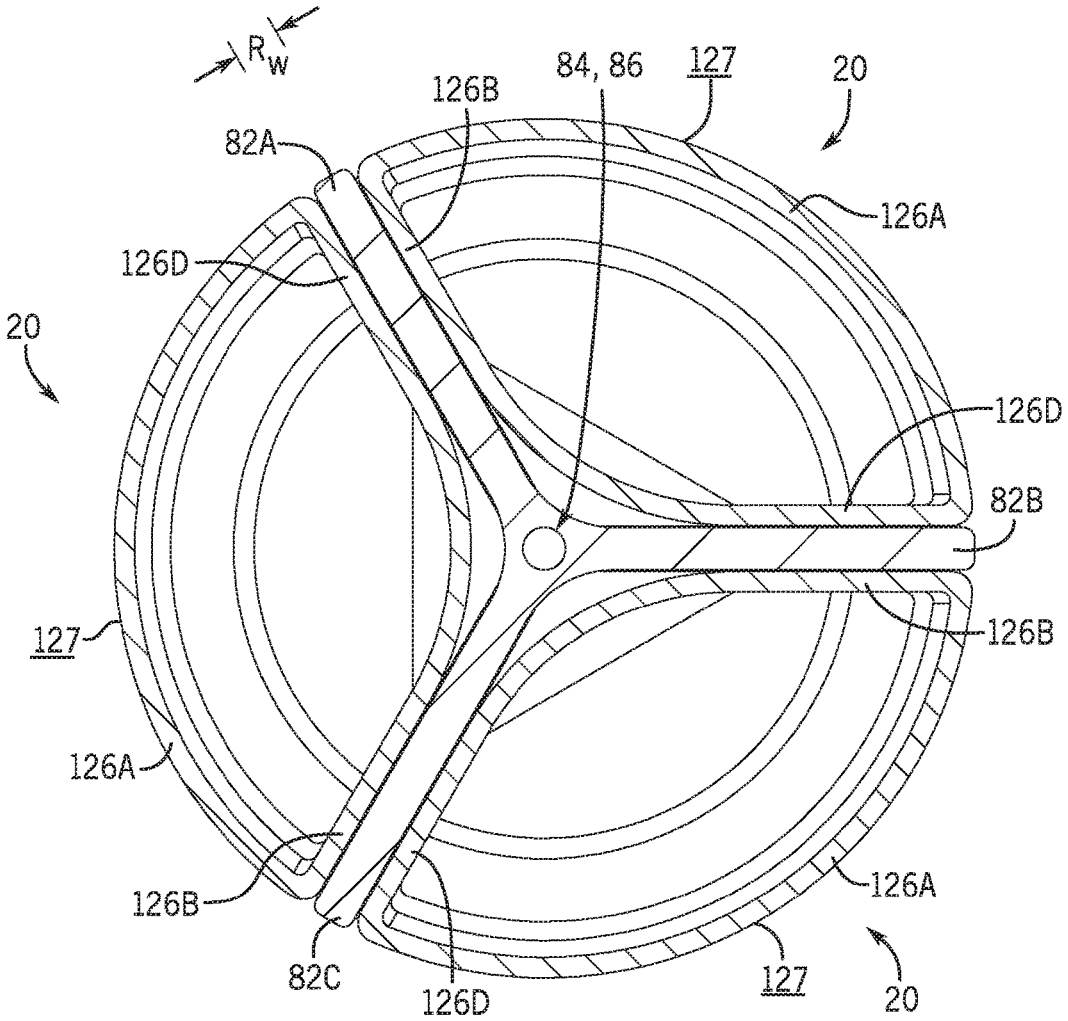
FIG. 10 is a cross-sectional view of the container shown in FIG. 1 taken along line 10-10 of FIG. 3.
Figure 11:
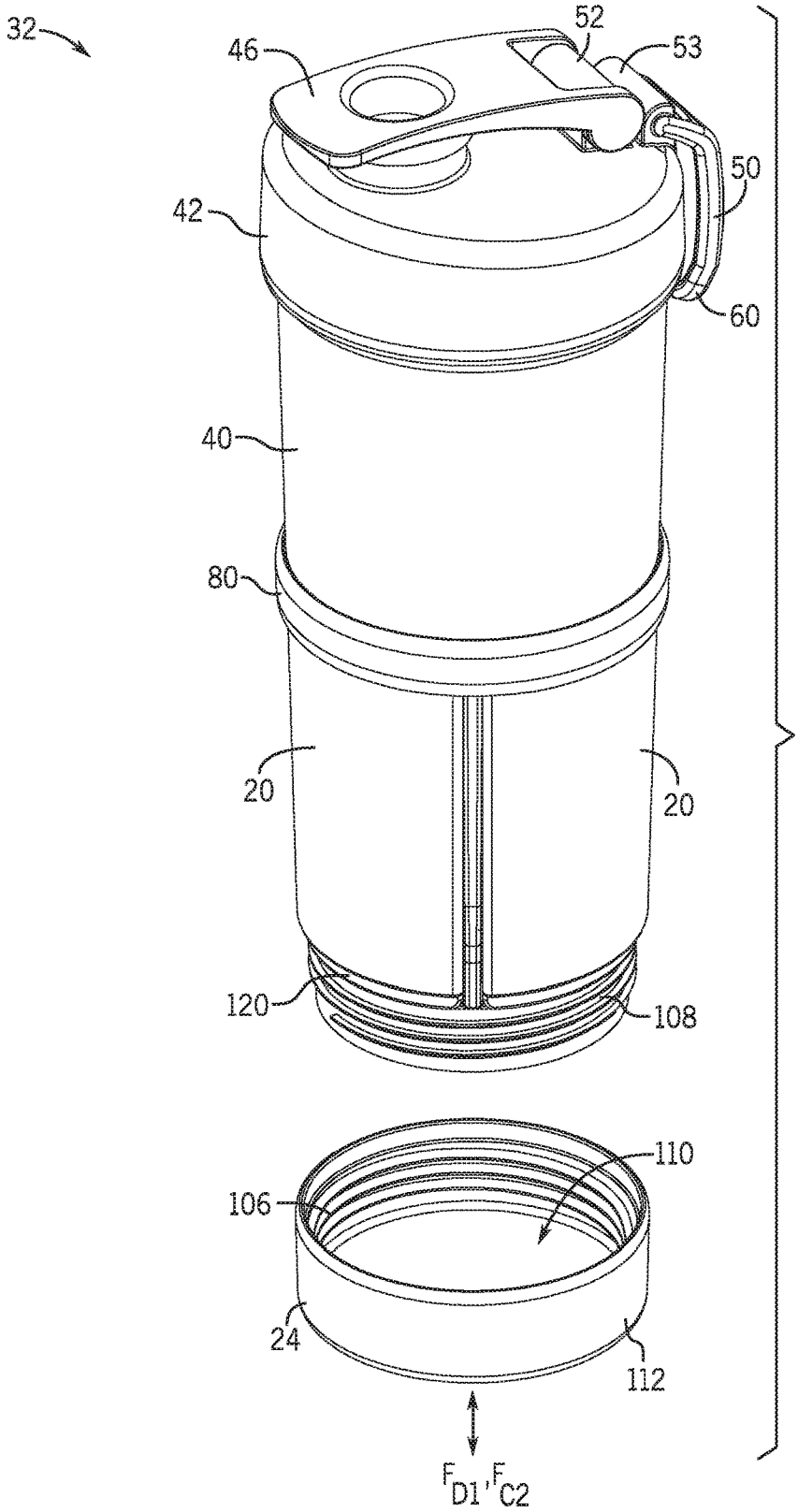
FIG. 11 is a perspective view of the container of FIG. 1 in a disconnected base state.

The ribs 82 have an elongated configuration, where the height $R_H$ of the rib 82 (see FIG. 9) is substantially greater than the width $R_W$ of the rib 82 (see FIG. 10). For example, the rib width $R_W$ may be between 10% and 30% of the rib height $R_H$. In one embodiment, a hollow cylinder 86 may be formed between the ribs 82 and substantially centered about the center point 84 of the cup 40. It should be understood that different number and configurations of the ribs 82 are contemplated by this disclosure. For example, the shape of the ribs 82 may vary. In particular, the ribs may have a straight, S-shaped, arched, or another type of curvilinear configuration. Additionally, the ribs 82 may not radiate outward from point 84 towards the outer edge 88. Instead, the ribs 82 may not even intersect the center point 84. For example, the rib assembly 64 may include a single rib 82 that has an arched shape and does not pass through the center point 84. Further, the areas formed between the ribs 82 may not be substantially identical. This, in turn, causes each of the integrated storage compartment 20 to be placed in a specific location in the container 10. In other words, the integrated storage compartment 20 would be keyed with the container 10. Moreover, it should be understood that any combination of rib 82 and/or rib assembly attributes (e.g., number of ribs 82, shape of each rib 82, arrangement of each rib 82 within the rib assembly 64, and elongated configuration of each rib 82) may be altered to meet the desired configuration of the container 10.

Figure 8:
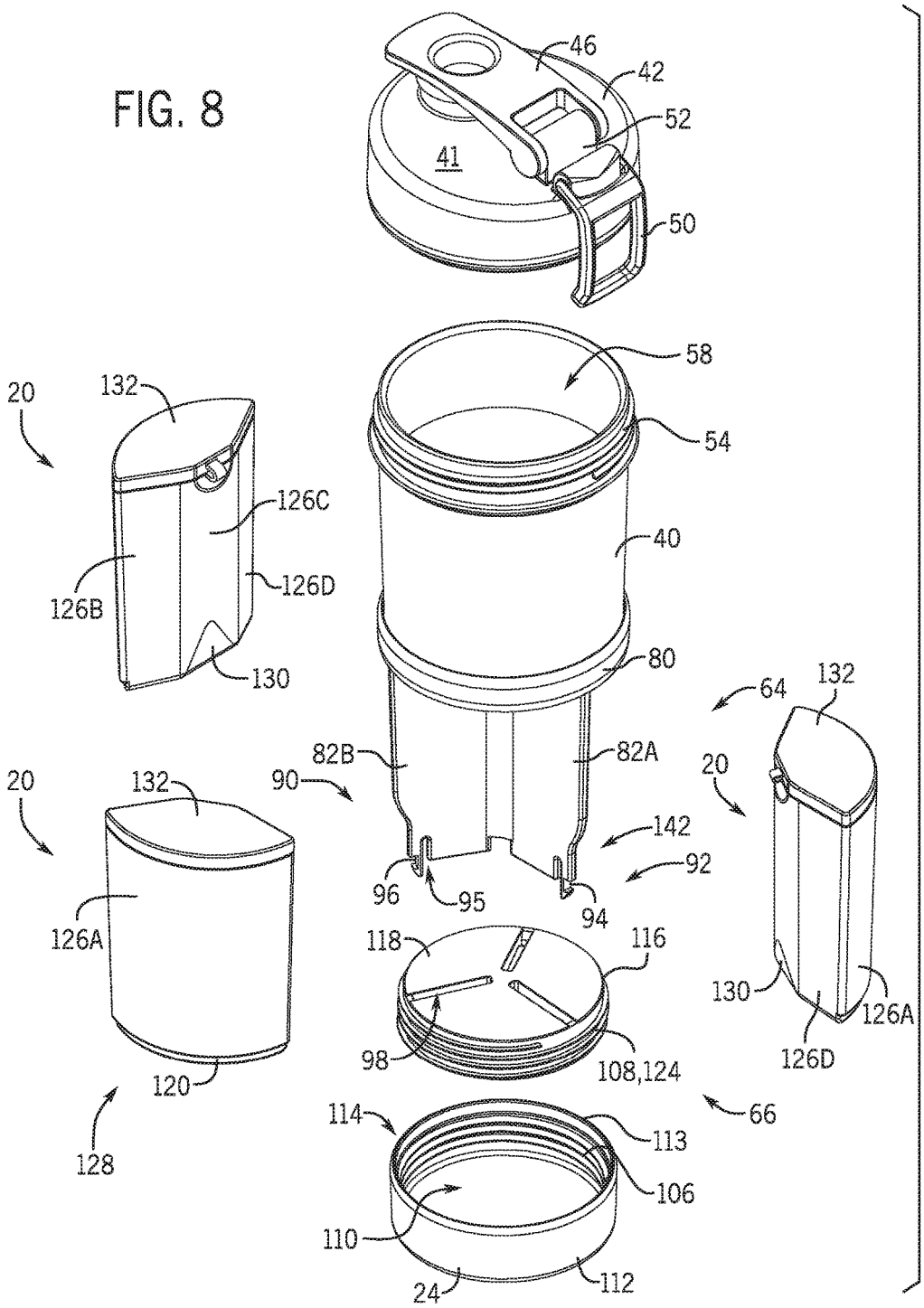
FIG. 8 is an exploded view of the container of FIG. 1.

Referring to FIGS. 8 and 9, each rib 82 has a coupling structure 92 that is positioned adjacent a bottom extent 90 of the rib 82 and is configured to couple the bottom member 66 to each of ribs 82 contained within the rib assembly 64. Specifically, this coupling structure 92 includes a projection 94 with a tab 96 and a gap 95. The projection 94 is configured to fit within an aperture 98 in the bottom member 66. In particular, to couple the bottom member 66 to each rib 82, the manufacturer or assembler of the container 10 applies downward and horizontal pressure on each rib 82 to force the projection 94 along with the tab 96 towards the center 84 of the container 10. This pressure will cause the projection 94 and the tab 96 to be temporarily placed in a compressed state, where the projection 94 is positioned in the gap 95. The manufacturer or assembler will continue to apply downward pressure on each rib 82, while the projection 94 and tab 96 are in this compressed state, until the top of the projection 94 is positioned below the bottom surface 100 of the bottom member 66. Once this occurs, the projection 94 and the tab 96 will return to their uncompressed or normal state and thus coupling the bottom member 66 to each rib 82. This process is then repeated for all other ribs 82 contained in the rib assembly 64. It should be understood that other methods of coupling the bottom member 66 to each rib 82 are contemplated by this disclosure. For example, the bottom member 66 may screw on to the rib assembly 64 or the bottom member 66 may be formed as one piece with the rib assembly 64.

Referring to FIGS. 1, 10 and 15, a first portion 21 of the rib assembly 64 in combination with the integrated storage compartment 20 has a substantially smooth outer surface. A second portion 23 of the rib assembly 64 in combination with the integrated storage compartment 20 does not have a substantially smooth outer surface. This is due in part to the fact that each rib 82 has a recessed extent 142, which positions the extent of the rib 82 inward from the outer surface 127 of the adjacent integrated storage compartment 20. This recessed extent 142 allows the user to place their thumb or finger within the recesses 142 in order to grasp a portion of the lower portion 140 of the integrated storage compartment 20 during the disconnection process. Without this recess 142, the user will not be able to effectively grasp an extent of the integrated storage compartment 20. It should be understood that other configurations or methods that allow a user to grasp a portion of the integrated storage compartment 20 are contemplated by this disclosure. For example, the first portion 21 could be omitted, wherein the container 10 would only have the configuration of the second portion 23. Further, the container 10 may only have a first portion 21 and each integrated storage compartment 20 could include a section that could be grasped by the user. Specifically, this grasping section could be a tab that is located on the bottom edge of the integrated storage compartment 20 and is contained within the removable base 24. Alternatively, the integrated storage compartment 20 may have a foldable hook positioned adjacent a lower portion 140 of the integrated storage compartment 20.

As described above, the intermediate cavity 102 is formed from an arrangement of the horizontal support member 68, a pair of ribs 82 and the bottom member 66. As mentioned above, the intermediate cavity 102 is configured to removably receive and secure the integrated storage compartment 20. In the embodiment of the Figures, the container 10 has multiple intermediate cavities 102 (e.g., three) and the same number of integrated storage compartments 20 (e.g., three). When the integrated storage compartment 20 is positioned within intermediate cavity 102, it is positioned below the intermediate wall 68. In other words, the integrated storage compartment 20 is positioned below the cup 40 and does not affect access to the contents of the cup 40. This configuration allows for the cup 40 to have a shorter height $C_H$ and a greater diameter $C_D$, which aids in the cleaning of the cup 40 by the user and helps ensure that the container 10 can fit within a conventionally-sized cup holder (e.g., a cup holder found in automobiles currently sold to consumers worldwide). This furthers the portability and utility of the container 10.

Referring to FIGS. 8-10 and 14-16, the integrated storage compartment 20 is formed from an arrangement of walls, which includes a plurality of substantially vertical walls 126, a bottom wall 128, a beveled inner wall 130, and an openable top 132. In particular, the beveled inner wall 130 extends between a bottom wall 128 and one of the vertical walls 126. The functionality of the beveled wall 130 is discussed below. In one embodiment, the integrated storage compartment 20 may have four substantially vertical walls 126*a*-126*d*. One of the substantially vertical walls 126*a* may have a curvilinear configuration outer wall 126*a* that matches the curvilinear configuration of the cup 40, while the other three substantially vertical walls 126*b-d* may be angled with respect to each other. Referring to FIG. 10, the angles of intersection between these walls 126*a*-126*d* should substantially match the angles of the ribs 82. Additionally, the height of the substantially vertical walls 126 is configured such that the top 132 and the bottom 128 make contact with both the intermediate wall 68 and the bottom member 66, respectively. This configuration allows the integrated storage compartment 20 to fit within the intermediate cavity 102 while maximizing the amount of storage space (e.g., 4 ounces) contained within the integrated storage compartment 20.

Figure 13:
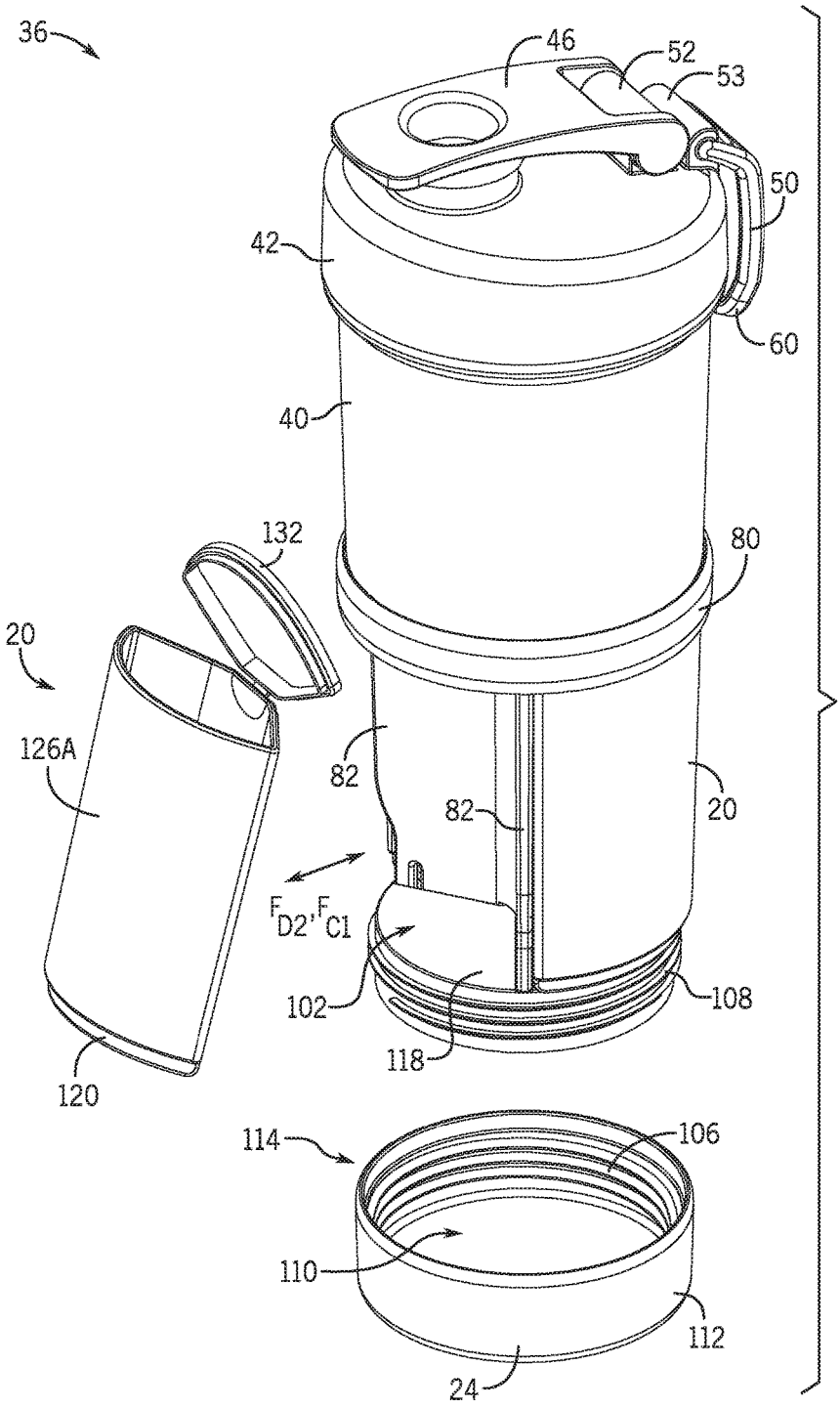
FIG. 13 is a perspective view of the container of FIG. 1 in the disconnected compartment state and a filling compartment state.

As shown in FIGS. 13 and 16, the top 132 may be removed from the rest of the arrangement of walls to allow the user to access the space contained within the integrated storage compartment 20. In particular, the top 132 may be a flip top that opens to allow the user to add or remove supplements from the integrated storage compartment 20. Referring to FIG. 9, the configuration of the vertical walls 126, the intermediate wall 68, and the bottom member 66 ensures that the top 132 does not become accidentally dislodged from the arrangement of walls that form the integrated storage compartment 20 while the integrated storage compartment 20 is retained within the intermediate cavity 102. This helps to ensure that the supplements that are contained within the integrated storage compartment 20 cannot accidentally leak out. It should be understood that different tops 132 may be utilized such as a threaded top, a partially threaded top, or any other cap known to one of skill in the art.

The bottom assembly 18 includes the removable base 24 with a base flange 112 that extends upwardly from the bottom wall 115. The base flange 112 has base engaging structures 106 that are formed on the interior of the base flange 112 and are configured to couple the base 24 to bottom engaging structures 108 of the bottom member 66. The bottom engaging structures 108 are formed on the exterior of a bottom flange 124 that extends downwardly from a top wall 118 of the bottom member 66. As shown in FIGS. 15 and 16, the top wall 118 is inclined and intersects the flange 124 at an angle that is not a right angle. Alternatively, the top wall 118 is substantially planar and not inclined, and thus forms a substantially a 90 degree angle with the flange 124. The engaging structures 106, 108 allow the user to removably couple the base 24 to the bottom member 66 upon the application of a first disconnection force $F_{D1}$. This configuration allows the user to remove the base 24 from the intermediate assembly 16, which in turn allows the user to access a lower integrated storage compartment or base storage compartment 110 formed within the base 24. In one embodiment, the engaging structures 106, 108 may are threads that are cooperatively dimensioned for rotational engagement of the base 24 and the bottom member 66. In particular, the bottom member's 66 engaging structures 108 may be external threads, while the base's 24 engaging structures 106 may be internal threads. These threads 106, 108 require that the user rotates the base 24 multiple times to unscrew it from the bottom member 66. It should be understood that the engaging structures 106, 108 may be a pin and socket, a quarter-turn thread, a partial thread, a bayonet connector, a friction fit, or any other type of similar connector that is known to one of skill in the art.

The arrangement of the base flange 112 and the bottom wall 115 form the lower integrated storage compartment 110 that can be utilized to transport or store: (i) keys, (ii) gym card, (iii) headphones, (iv) supplements (e.g., pills, capsules), (v) a funnel for directing supplements into the integrated storage compartments 20, (vi) a collapsible mixing ball, (vii) a mixing grate, (viii) a spoon, stir or other small utensil, or (ix) any other structure that may aid the user in positioning, mixing, or consuming the supplements contained within any of the integrated storage compartments 20, 110.

The base 24 includes the second retaining member 114 that is formed as part of the flange 112. In the embodiment of the Figures, the retaining member 114 is positioned adjacent the open or free end of the flange 112 and is configured to engage the integrated storage compartment 20 in the assembled position 30. Specifically, when the integrated storage compartment 20 is positioned within the intermediate cavity 102, the second retaining member 114 extends above an upper edge 116 of the bottom member 66 and overlies a lower extent of the storage compartment 20. As shown in FIG. 9, a recess 120 is formed in the walls 126*a* of the integrated storage compartment 20 and the second retaining member 114 overlies the recess 120 by being positioned radially outward of an outer surface 122 of the recess 120. Thus, the recess 120 is obscured from view by the second retaining member 144 (as shown in FIGS. 1-5). In this state, the second retaining member 114 obstructs the removal of the integrated storage compartment 20 from the intermediate cavity 102. This ensures that the integrated storage compartment 20 cannot be inadvertently disengaged or disconnected from the intermediate cavity 102.

The Figures show the container 10 in various operating states. FIGS. 1-7, 9 and 10 show the container 10 in the assembled state 30, where the container 10 be carried from location to location by the user. Also, in the assembled state 30 the removable base 24 is coupled to the intermediate assembly 16 and each of the integrated storage compartments 20 are retained within an intermediate cavity 102. In this assembled state 30, both the first and second retaining structures 80, 114 removably secure the integrated storage compartment 20 within the intermediate cavity 102 which ensures that the compartments 20 cannot be inadvertently disconnected.

FIGS. 11 and 14 show the container 10 in a first partially disassembled state or a disconnected base state 32. Specifically, the integrated storage compartment 20 remains within the intermediate cavity 102, but the base 24 has been removed from the intermediate assembly 16. Specifically, the base's 24 engaging structure 106 has been disengaged from the engaging structures 108 of the bottom member 66 by the application of a first disconnection force $F_{D1}$. To arrive at this position, the user disengages the base 24 from the bottom member 66 by applying a first rotational force that unscrews the base 24 from the bottom member 66. The displacement of the base 24 from the intermediate assembly 16, disengages the second retaining member 114 from the storage compartments 20. In other words, the second retaining member 114 is removed from obstructing the horizontal movement of the bottom wall 128 of the integrated storage compartment 20. The base 24 does not have to be fully disconnected from the intermediate assembly 16 to disengage the container's 10 second retaining member 114. Instead, the second retaining member 114 can be disengaged by partial removal of the base 24 from the intermediate assembly 16, as long as the second retaining member 114 does not obstruct the radially outward displacement of the integrated storage compartment 20. Disengagement by partial removal of the base 24 results from the threads 106 being formed a distance from the upper edge 113 of the flange 112, which means the threads 106 are not coincident with the upper edge 113.

Figure 12:
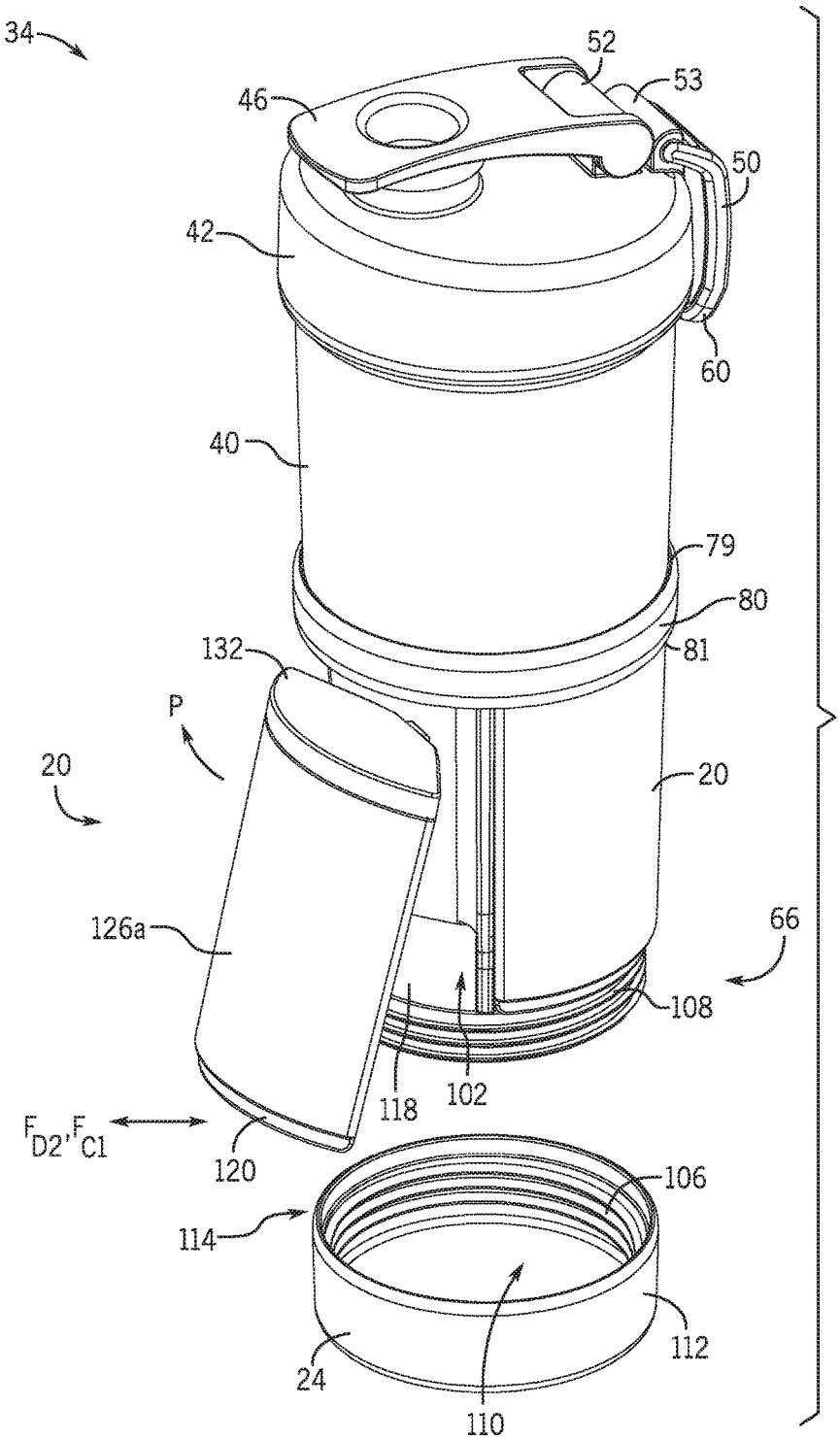
FIG. 12 is a perspective view of the container of FIG. 1 in a disconnected compartment state.

FIG. 12 shows the container 10 in a disconnected compartment state 34, where the storage compartment 20 is disconnected from the container 10. FIG. 15 shows the container 10 progressing to a disconnected compartment state where the storage compartment 20 is partially removed from the cavity 102, but the upper portion of the compartment 20 remains engaged with the first retaining member 80. Specifically, the base 24 has been removed from the intermediate assembly 16 and a second disconnection force $F_{D2}$, which is oriented substantially horizontal or perpendicular to the longitudinal axis A-A (see FIG. 15) of the container 10, is applied to a lower portion 140 of the integrated storage compartment 20. To apply this second disconnection force or radially outward force $F_{D2}$, a user places their thumb and a finger within recesses 142 formed within the rib assembly 64. Once the user has grasped a portion of the lower portion 140, the user can apply the second disconnection force $F_{D2}$ on the integrated storage compartment 20. The application of the second disconnection force $F_{D2}$ to the compartment 20 causes: (i) the first retaining member 80 to elastically deform due to the interaction with the upper potion 103 of the compartment 20, and (ii) the lower portion 140 of the integrated storage compartment 20 to pivot P around an extent 81 of the first retaining member 80. Once the integrated storage compartment 20 has pivoted enough (e.g., approximately 30°) to allow the upper extent 103 of the integrated storage compartment 20 to disengage with the first retaining member 80, the integrated storage compartment 20 can be fully removed from the intermediate cavity 102. To note, the beveled inner wall 130 allows the lower portion 140 of the container to clear the upper edge 116 of the bottom member 66 upon the application of the second disconnection force $F_{D2}$ on the integrated storage compartment 20. Without this beveled inner wall 130, the integrated storage compartment 20 could not be pivotally removed from the intermediate cavity 102, and thus could not be disengaged from the intermediate cavity 102.

FIGS. 13 and 16 show the container 10 in a third disassembled state or filling compartment state 36, wherein both the base 24 and the integrated storage compartment 20 have been removed from the intermediate assembly 16. In this filling state 36, the integrated storage compartment 20 is completely removed from the intermediate assembly 16 and can be filled with a substance (e.g., protein powder, nuts, fruit, or other supplements) or the substance contained within the integrated storage compartment 20 may be emptied into a cup portion 40 of the intermediate assembly 16.

It should be understood that these steps are performed in the reverse order in order to couple the integrated storage compartment 20 to the intermediate cavity 102. First, the user must confirm whether the second retaining member 114 is positioned in a manner that obstructs the insertion of the bottom extent 140 of the integrated storage compartment 20. If the base 24 is in this position, the user must apply the first disconnection force $F_{D1}$ on the base 24 to move the base 24 to a state where the second engaging structure 114 does not obstruct the insertion of the integrated storage compartment 20. Once the user has confirmed that second engaging structure 114 will not obstruct this insertion, the user inserts the upper extent 103 of the integrated storage compartment 20 between the first retaining member 80 and the rib 82. As such, the upper extent 103 is positioned between the first retaining member 80 and the ribs 82. Referring to FIG. 15, the user then applies an inwardly directed first connection force $F_{C1}$, which is oriented substantially horizontal or perpendicular to the longitudinal axis A-A of the container 10 on the lower portion 140 of the integrated storage compartment 20. The user continues to apply the inwardly directed first connection force $F_{C1}$ until: (i) the beveled inner wall 130 clears the upper edge 116 of the bottom member 66 and (ii) the bottom wall 128 is in contact with the bottom wall 128. This multi-step action of inserting the upper extent 103 and then applying an inwardly directed force results in pivotal movement of the compartment 20 into the cavity 102. After the compartment 20 is fully inserted into the cavity 102, the user couples the base 24 to the bottom member 66 by applying a second connection force $F_{C2}$ to engage the base's 24 engaging structure 106 with the engaging structures 108 of the bottom member 66. For example, this second connection force $F_{C2}$ includes screwing the base 24 onto the bottom member 66. Once the base 24 is fully connected to the bottom member 66, the second retaining structure obstructs the horizontal movement of the integrated storage compartment 20. Accordingly, container 10 is again in the assembled state 30. Thus, the container 10 provides for the efficient transportation and consumption of substances (e.g., protein powder, nuts, fruits, or other supplements) at various locations.

In an alternative embodiment, the threaded base and bottom engaging structures 106, 108 are replaced with coupling structure that does not require complete rotation(s) for connection or disconnection. For example, a bayonet connector-style connection system allows the base 24 to be partially disconnected from the intermediate assembly 16 upon a first partial rotation of the base 24. This partial disconnection disengages the second retaining member 114 from the storage compartments 20 whereupon the base 24 can be further displaced from the intermediate assembly 16. As described above, the user can then remove or insert the integrated storage compartment 20 in the intermediate cavity 102 upon the application of the force $F_{D2}$ on the integrated storage compartment 20. Upon a second partial rotation of the base 24 or upon applying a force that is substantially parallel $F_{D1}$ with the longitudinal axis A-A to the base 24 (see FIG. 14), the base 24 can be fully disconnected from the intermediate assembly 16. The full disconnection of the base 24 from the intermediate assembly 16 allows the user to access the lower integrated storage compartment 110.

In a further embodiment, the threaded base 24 and bottom engaging structures 106, 108 may be replaced with a substantially smooth surface. A spring loaded elongated pin, with a quarter-turn interlock, may then be placed within the hollow cylinder 86 and coupled to the base 24. This spring loaded pin couples the base 24 to the intermediate assembly 16. To disconnect the second retaining member 114, the user applies a first disconnection force $F_{D1}$ (see FIG. 14) on the base 24 that is large enough to overcome the spring's bias. While applying this force $F_{D1}$, the user also would apply a force $F_{D2}$ on the integrated storage compartment 20 to connect or disconnect from the intermediate assembly 16. Once the integrated storage compartment 20 is connected or disconnected from the intermediate assembly 16, the user releases the base 24, which causes the spring-loaded pin to return back to its unbiased position. This, in turn, causes the base 24 to also return to its unbiased position, where the base 24 engages the intermediate assembly 16 and the second retaining member 114 overlies and engages the integrated storage compartments 20. Also, the user applies the first disconnection force $F_{D1}$ and the base 24 is angularly displaced a quarter-turn, the base 24 can be fully disconnected from the intermediate assembly 16. The full disconnection of the base 24 from the intermediate assembly 16 allows the user to access the lower integrated storage compartment 110 to add or remove contents therein.

In a further embodiment, the first structure 80 is replaced by means for releasably securing the storage compartment 20 in the cavity 102, while the second retaining structure 114 is maintained. For example, the releasable securement means is a receptacle, aperture, groove or channel formed in either the intermediate wall 68 or the rib 82. That component of the means is cooperatively dimensioned to receive a projection, pin, or tab extending from the compartment 20, for example, extending from the inner wall 126*c* of the compartment 20. In this configuration, the user would first disconnect the securement means located proximate to the upper portion 103 of the integrated storage compartment 20. Then the user would apply a disconnection force that includes a horizontal component and a vertical component on the integrated storage compartment 20 to disconnect the integrated storage compartment 20 from the intermediate assembly 16. Alternatively, the first structure 80 is maintained, while the second retaining structure 114 is replaced by means for releasably securing the storage compartment 20 in the cavity 102. For example, the releasable securement means is a receptacle, aperture, groove or channel formed in top wall 118. That component of the means is cooperatively dimensioned to receive a projection, pin, or tab extending from the compartment 20, for example, extending from the bottom 128 of the compartment 20. Neither of these configurations require the alteration of the base 24 and as such the base 24 can be disconnected from the intermediate assembly 16 in the same manners as described above.

In yet another version, the first and second structures 80, 114 are replaced by means for releasably securing the storage compartment 20 in the cavity 102. For example, the releasable securement means is a receptacle, aperture, groove or channel formed in either: (i) the intermediate wall 68 or the rib 82, (ii) the top wall 118, or (iii) a combination of the intermediate wall 68 and the top wall 118. That component of the means is cooperatively dimensioned to receive a projection, pin, or tab extending from the compartment 20 (e.g., the inner wall 126*c*, the top wall 132, the bottom wall 128, or a combination of the top wall 132 and the bottom wall 128) of the compartment 20. In this configuration, the compartment 20 can be inserted with a connection force $F_C$ that is oriented radially inward and substantially perpendicular to the longitudinal axis A-A. The compartment 20 can be removed from the cavity 102 by application of a disconnection force $F_D$ that is oriented radially outward and substantially perpendicular to the longitudinal axis A-A.

In a further embodiment of the container 10, the first retaining member 80 is omitted but the securement functionality provided by the second retaining member 114 is retained. Here, the first retaining member 80 is replaced by a magnet positioned within a rib 82 or the cylinder 86 while a metallic element may be molded into the compartment or a metallic substance may be applied to the inner wall 126*c* of the storage compartment 20. For example, the magnet may be a N50 magnet (i.e., a neodyminum N50 magnet), which generates a magnet force of approximately 4600 Gs. When the compartment 20 is brought into close proximity of the cavity 102, a magnetic force will be exerted between the magnet and the compartment 20 to removably secure the compartment 20 within the cavity 102. Thus, to remove or insert an integrated storage compartment 20 into the intermediate cavity 102, the user would disconnect the second retaining member 114 in the same manner as described above. Once the second retaining member 114 is disconnected via the application of the first disconnection force $F_{D1}$, the user can apply a second disconnection force $F_{D2}$ on the integrated storage compartment 20 that is large enough to overcome the above-described magnetic force. Once this magnetic force is overcome, the integrated storage compartment 20 is removed from the intermediate assembly 16. In yet another version, the magnet is sized and configured to provide a significant attraction force such that the compartment 20 can be retained within the cavity 102 such that the second retaining member 114 can be omitted. In this configuration, the compartment 20 can be inserted with a connection force $F_C$ that is oriented radially inward and substantially perpendicular to the longitudinal axis A-A. The compartment 20 can be removed from the cavity 102 by application of a disconnection force $F_D$ that is oriented radially outward and substantially perpendicular to the longitudinal axis A-A.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings. Other implementations are also contemplated.

While some implementations have been illustrated and described, numerous modifications come to mind without significantly departing from the spirit of the disclosure; and the scope of protection is only limited by the scope of the accompanying claims. For example, the intermediate wall 68 may be split into two walls, wherein a first wall forms a base for the cup 40 and a second wall formed the top of the integrated cavity. This configuration allows the first and second walls to coupled to one another in a first configuration and for the walls to be separated from one another in a second configuration. In the first configuration, the container assembly is fully assembled and ready for use. In the second configuration, the user can remove the cup from other components of the container 10 to aid the user in washing the container 10. Additionally, the shape of the container 10 may be a sphere, rectangular, oval, hexagonal, pentagonal, or any other similar shape. The container 10 may have an anti-microbial coating, may be formed from metal, such as aluminum or steel, a polymer material, such as plastic, or a combination of metal and a polymer material. In certain embodiments, only the cup 40 may be insulated, using either a single or dual wall design. In other embodiments, the cup 40 and a predetermined number of integrated storage compartment 20 may be insulated. In further embodiments, the cup 40 and all of the integrated storage compartments 20 may be insulated. The container 10 may contain various color schemes. For example, the base 24, the first retaining member 80, and the cap 46 may be one color (e.g., white), while the rest of the components may be a second color (e.g., black). Other color combinations and material combinations are contemplated by this disclosure.

Headings and subheadings, if any, are used for convenience only and are not limiting. The word exemplary is used to mean serving as an example or illustration. To the extent that the term includes, have, or the like is used, such term is intended to be inclusive in a manner similar to the term comprise as comprise is interpreted when employed as a transitional word in a claim. Relational terms such as first and second and the like may be used to distinguish one entity or action from another without necessarily requiring or implying any actual such relationship or order between such entities or actions.

Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

Numerous modifications to the present disclosure will be apparent to those skilled in the art in view of the foregoing description. Preferred embodiments of this disclosure are described herein, including the best mode known to the inventors for carrying out the disclosure. It should be understood that the illustrated embodiments are exemplary only, and should not be taken as limiting the scope of the disclosure.

We claim:

1. A drink container with at least one integrated storage compartment, the drink container comprising:

a top assembly having a removable top member and an openable cap operably connected to the top member;

an intermediate assembly having:

an intermediate wall and a side wall that upwardly extends from the intermediate wall, wherein the combination of the top member, the intermediate wall and the side wall form an openable chamber configured to receive contents for consumption by a user of the drink container, a rib that downwardly extends from the intermediate wall and engages with an extent of a bottom member, and wherein the arrangement of the rib, the bottom member, and the intermediate wall collectively form at least one intermediate cavity configured to receive a storage compartment for additional contents for consumption by the user;

a first retaining member positioned adjacent to a periphery of the intermediate wall;

a base having a second retaining member positioned adjacent to a periphery of the bottom member; and, wherein in an assembled state, the first and second retaining members engage the storage compartment to retain it in the intermediate cavity during use of the drink container.

2. The drink container of claim 1, wherein in order to move from the assembled state to a disconnected compartment state, a first disconnection force is applied to the base to displace it from the intermediate assembly such that the second retaining member does not obstruct a lower portion of the storage compartment.

3. The drink container of claim 2, wherein application of a second disconnection force to the storage compartment causes the storage compartment to disconnect from the intermediate cavity to arrive at the disconnected compartment state.

4. The drink container of claim 3, wherein the second disconnection force is (i) applied to a lower portion of the storage compartment and (ii) oriented radially outward from a longitudinal axis of the drink container.

5. The drink container of claim 4, wherein the storage compartment is comprised of an arrangement of walls including a beveled wall extending between a bottom wall and an internal wall that facilitates pivoting of the storage compartment during the application of the second disconnection force.

6. The drink container of claim 4, wherein application of the second disconnection force to the lower portion of the storage compartment causes the storage compartment to pivot while an upper portion of the storage compartment is engaged by the first retaining member.

7. The drink container of claim 6, wherein the storage compartment is disengaged from the intermediate cavity when the second disconnection force overcomes the engagement between the upper portion of the storage compartment and the first retaining member.

8. The drink container of claim 6, wherein the first retaining member elastically deforms during the engagement between the storage compartment and the first retaining member under application of the second disconnection force.

9. The drink container of claim 1, wherein to reach the assembled state (i) an upper portion of the storage compartment is positioned within both the intermediate cavity and the first retaining member, (ii) a first connection force is applied to the storage compartment causing the storage compartment to pivot about its upper portion and reside within the intermediate cavity, and (iii) a second connection force is applied to the base to bring it into engagement with the intermediate assembly such that the second retaining member obstructs the lower portion of the storage compartment.

10. The drink container of claim 9, wherein the first connection force is a radially inward directed force applied to the storage compartment.

11. The drink container of claim 1, wherein the base includes a bottom wall and a flange extending from the bottom wall to define a base storage compartment, and wherein the second retaining member is formed at an open end of the flange.

12. The drink container of claim 11, wherein the flange also includes internal threads formed between the second retaining member and the bottom wall of the base.

13. The drink container of claim 12, wherein the flange includes external threads that mate with internal threads formed in a flange of the base to couple the intermediate assembly to the base in the assembled state.

14. The drink container of claim 1, wherein the bottom member of the intermediate assembly includes a top wall and a flange downwardly extending from the top wall.

15. The drink container of claim 1, wherein the rib has a recessed section that is configured to allow a user to grasp an extent of the storage compartment.

16. The drink container of claim 1, wherein in the assembled state, at least a lower extent of the first retaining member overlies an upper portion of the storage compartment.

17. The drink container of claim 1, wherein the intermediate assembly includes a peripheral recess that receives an extent of the first retaining member in the assembled state, and wherein at least a lower extent of the first retaining member overlies an upper portion of the storage compartment.

18. A drink container with multiple integrated storage compartments, the drink container comprising:

a top assembly having a removable top member and an openable cap operably connected to the top member;

an intermediate assembly having:

an intermediate wall and a side wall that upwardly extends from the intermediate wall to form a chamber configured to receive contents for consumption by a user of the drink container, a bottom member, at least one rib that extends upward from the bottom member towards the intermediate wall, wherein the arrangement of the rib, the bottom member, and the intermediate wall collectively form a plurality of intermediate cavities, wherein each cavity is configured to receive an integrated storage compartment for additional contents for consumption by the user;

a first retaining member;

a base having a second retaining member; and wherein in an assembled state: (i) the integrated storage compartment is positioned within the cavity, (ii) the first retaining member engages an upper portion of the integrated storage compartment, and (iii) the second retaining member engages a lower portion of the integrated storage compartment.

19. The drink container of claim 18, wherein the intermediate assembly includes three ribs that extend upward from the bottom member to form three distinct intermediate cavities.

20. The drink container of claim 18, wherein in order to move from the assembled state to a disconnected compartment state: (i) a first disconnection force is applied to the base to displace it from the intermediate assembly such that the second retaining member does not engage a lower portion of the integrated storage compartments, and (ii) a second disconnection force is applied to the integrated storage compartment to disconnect it from the intermediate cavity.

21. The drink container of claim 20, wherein the second disconnection force is (i) applied to a lower portion of the integrated storage compartment and (ii) oriented radially outward from a longitudinal axis of the drink container.

22. The drink container of claim 20, wherein the integrated storage compartment is comprised of an arrangement of walls including a beveled wall that facilitates pivoting of the integrated storage compartment during the application of the second disconnection force.

23. The drink container of claim 20, wherein application of the second disconnection force to the lower portion of the integrated storage compartment causes the integrated storage compartment to pivot while an upper portion of the integrated storage compartment is engaged by the first retaining member.

24. The drink container of claim 23, wherein the integrated storage compartment is disengaged from the intermediate cavity when the second disconnection force overcomes the engagement between the upper portion of the integrated storage compartment and the first retaining member.

25. The drink container of claim 24, wherein the first retaining member elastically deforms during the engagement between the integrated storage compartment and the first retaining member while the second disconnection force is applied.

26. The drink container of claim 18, wherein the base includes a bottom wall and an upwardly extending flange that define a base storage compartment, and wherein the second retaining member is formed at an open end of the flange.

27. The drink container of claim 26, wherein the bottom member of the intermediate assembly includes a top wall and a downwardly extending flange, and wherein the downwardly extending flange of the bottom member mates with the upwardly extending flange of the base in the assembled state.

28. The drink container of claim 18, wherein in the assembled state (i) at least a lower extent of the first retaining member overlies an upper portion of the integrated storage compartment, and (ii) at least an upper extent of the second retaining member overlies a lower portion of the integrated storage compartment.

29. The drink container of claim 18, wherein the intermediate assembly includes a peripheral recess that receives an extent of the first retaining member in the assembled state, wherein at least a lower extent of the first retaining member overlies an upper portion of the integrated storage compartment.

* * * * *